US008429789B2

(12) United States Patent
Sheddy et al.

(10) Patent No.: US 8,429,789 B2
(45) Date of Patent: Apr. 30, 2013

(54) VACUUM HAVING ACCESSORY STORAGE FEATURES

(75) Inventors: Gregg L. Sheddy, Shrewsbury, PA (US); Stuart J. Wright, Timonium, MD (US); Kathy E. DiPasquale, Baltimore, MD (US); Spencer G. Maid, Harland, WI (US)

(73) Assignee: Black & Decker Inc., Newark, DE (US)

( * ) Notice: Subject to any disclaimer, the term of this patent is extended or adjusted under 35 U.S.C. 154(b) by 28 days.

(21) Appl. No.: 12/899,592

(22) Filed: Oct. 7, 2010

(65) Prior Publication Data

US 2011/0023258 A1 Feb. 3, 2011

Related U.S. Application Data

(62) Division of application No. 11/870,959, filed on Oct. 11, 2007, now Pat. No. 8,046, 868.

(60) Provisional application No. 60/859,945, filed on Nov. 20, 2006.

(51) Int. Cl.
*A47L 5/36* (2006.01)

(52) U.S. Cl.
USPC ..... 15/323; 15/327.2; 15/327.4; 15/327.6; 15/328; 15/410

(58) Field of Classification Search ..... 15/323, 15/327.2, 327.4, 327.6, 410, 328; *A47L 5/36*
See application file for complete search history.

(56) References Cited

U.S. PATENT DOCUMENTS

| | | | | |
|---|---|---|---|---|
| 2,920,337 | A | 1/1960 | Smith | |
| 3,869,265 | A | 3/1975 | Wolter et al. | |
| 4,222,145 | A | 9/1980 | Lowder | |
| 5,388,301 | A * | 2/1995 | Bosyj et al. | 15/327.1 |
| 5,528,794 | A * | 6/1996 | Tomasiak | 15/323 |
| 5,606,769 | A | 3/1997 | Tomasiak et al. | |
| D443,739 | S | 6/2001 | Young et al. | |
| D446,612 | S | 8/2001 | Kohler et al. | |
| D467,694 | S | 12/2002 | Kitts | |
| 6,510,583 | B2 | 1/2003 | Griffin et al. | |
| D521,700 | S | 5/2006 | Griffin | |
| D528,255 | S | 9/2006 | Griffin et al. | |
| 7,237,300 | B2 | 7/2007 | Tomasiak et al. | |
| 2005/0055794 | A1 | 3/2005 | Marshall et al. | |

FOREIGN PATENT DOCUMENTS

| | | |
|---|---|---|
| EP | 0607058 | 7/1994 |

* cited by examiner

*Primary Examiner* — David Redding
(74) *Attorney, Agent, or Firm* — Harness, Dickey & Pierce, P.L.C.

(57) ABSTRACT

A vacuum including a housing with a suction device disposed within the housing is provided. The vacuum can also include a frame having a plurality of wheels mounted thereto. The frame can include an aperture, which can be adapted to removably receive the housing therein. The frame can have a handle attached thereto.

11 Claims, 5 Drawing Sheets

VACUUM HAVING ACCESSORY STORAGE FEATURES

CROSS-REFERENCE TO RELATED APPLICATIONS

This application is a divisional of U.S. patent application Ser. No. 11/870,959 filed on Oct. 11, 2007. This application claims the benefit of U.S. Provisional Application No. 60/859,945, filed on Nov. 20, 2006. The entire disclosures of each of the above applications are incorporated herein by reference.

FIELD

The present disclosure relates to vacuums, and in particular, to a vacuum with accessory storage features.

BACKGROUND

The statements in this section merely provide background information related to the present disclosure and may not constitute prior art.

Many vacuum cleaners, especially shop vacuums, include a variety of accessories that may be attached to the vacuum to aid in the collection of waste matter. These accessories may include extensions to increase the reach of the vacuum, and a variety of nozzles and other attachments shaped to facilitate vacuuming on various surfaces and in tight spaces.

Typically, vacuums do not include satisfactory storage means for idle accessories. These vacuums fail to securely retain accessories in a space efficient manner. Accessories often must be stored separately from the vacuum, which requires the user to interrupt vacuuming to retrieve the accessories as needed.

SUMMARY

Provided is a vacuum, which can include a housing with a suction device disposed within the housing. The vacuum can also include a frame having a plurality of wheels mounted thereto. The frame can include an aperture, which can be adapted to removably receive the housing therein. The frame can have a handle attached thereto.

Further provided is a vacuum, which can comprise a housing having a first end opposite a second end. The vacuum can include at least one housing handle coupled to the first end of the housing, and a plurality of auxiliary wheels coupled to the second end of the housing. The plurality of auxiliary wheels can be operable to enable the housing to move when the housing is in a first state. The vacuum can also include a suction device disposed within the housing, and a frame. The frame can define an aperture adapted to removably receive the housing therein. The frame can include a handle. The vacuum can also comprise a plurality of wheels coupled to the frame about the aperture. The plurality of wheels can be operable to enable the housing to move when the housing is in a second state. In the second state, the housing can be received within the aperture of the frame.

According to various aspects, a vacuum is provided. The vacuum can include a housing having a first end opposite a second end. The second end can have a first taper. The vacuum can also include at least one handle coupled to the first end of the housing, and a suction device disposed within the housing. The vacuum can include a frame defining an aperture having a second taper, and a plurality of wheels coupled to the frame. The first taper of the housing can cooperate with the second taper of the frame to removably receive the housing within the aperture.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
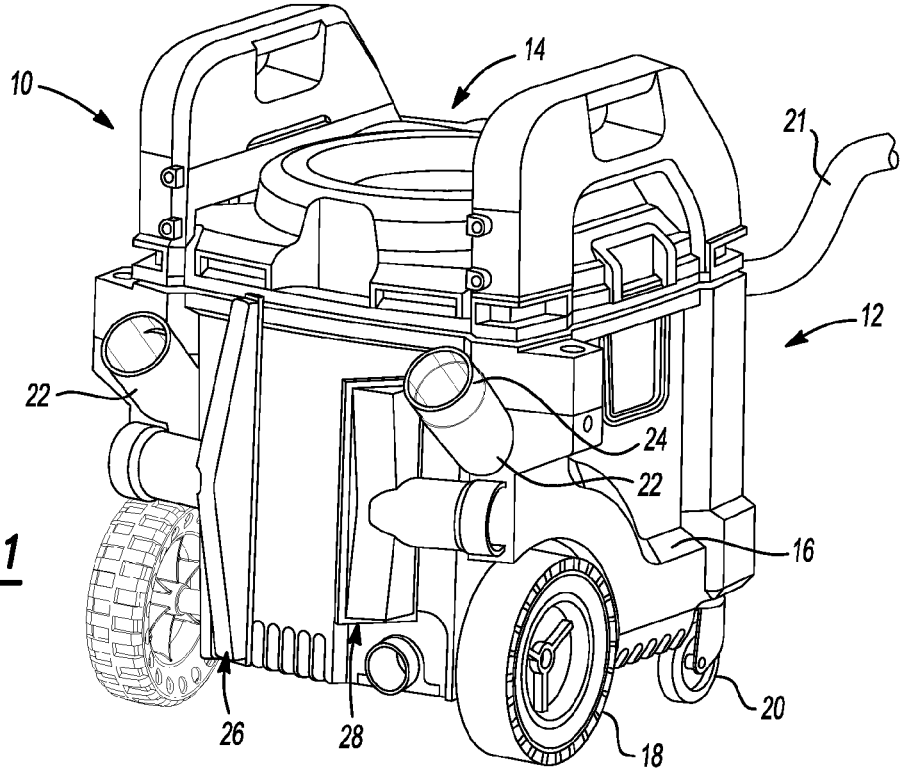
FIG. 1 is a perspective view of a vacuum according to the principles of the present disclosure.
Figure 2:
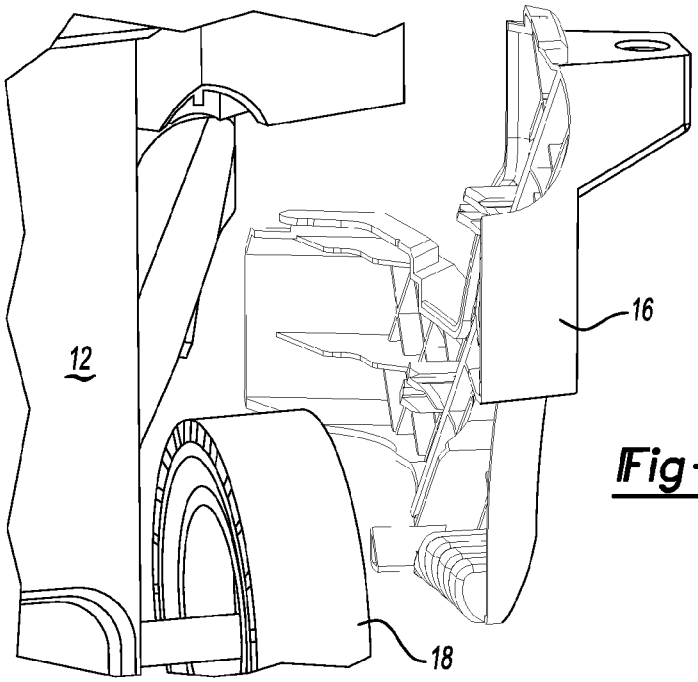
FIG. 2 is a partially exploded perspective view illustrating a bumper according to the principles of the present disclosure.

The following description is merely exemplary in nature and is not intended to limit the present disclosure, application, or uses. It should be understood that throughout the drawings, corresponding reference numerals indicate like or corresponding parts and features.

Referring to FIGS. 1-6, a vacuum with accessory storage features is shown, and is generally referred to as vacuum 10. Vacuum 10 includes a housing 12 that encloses a suction device. The suction device is generally located within housing 12 at 14, and includes a mechanism that creates a suction force operable to collect dirt, debris, and other wet or dry waste matter, as known in the art. For example, suction device 14 may include an electric motor driving a suction impeller (not shown).

Housing 12 may include one or more bumpers 16. Vacuum 10 may include a plurality of wheels 18 and/or one or more caster wheel 20 to facilitate mobility and maneuverability. Bumpers 16 may extend laterally from housing 12 so as to be operable to shield wheels 18 and/or caster wheels 20 from damaging impacts and/or debris.

Suction device 14 provides a suction force to a flexible vacuum hose 21 extending from the housing, which may be adapted to receive a variety of accessories, such as extension wands 22, crevasse tool 24, floor nozzles 26, 28, and other attachments. Extension wands 22 may be in fluid communication with suction device 14 to extend the functional reach of vacuum 10 during operation. Crevasse tool 24 and floor nozzles 26, 28 may be in fluid communication with suction device 14 to facilitate efficient vacuuming over a variety of surfaces and in restricted spaces. Any of floor nozzles 26, 28 and crevasse tool 24 may be used in conjunction with extension wands 22 or independently therefrom.

Figure 3:
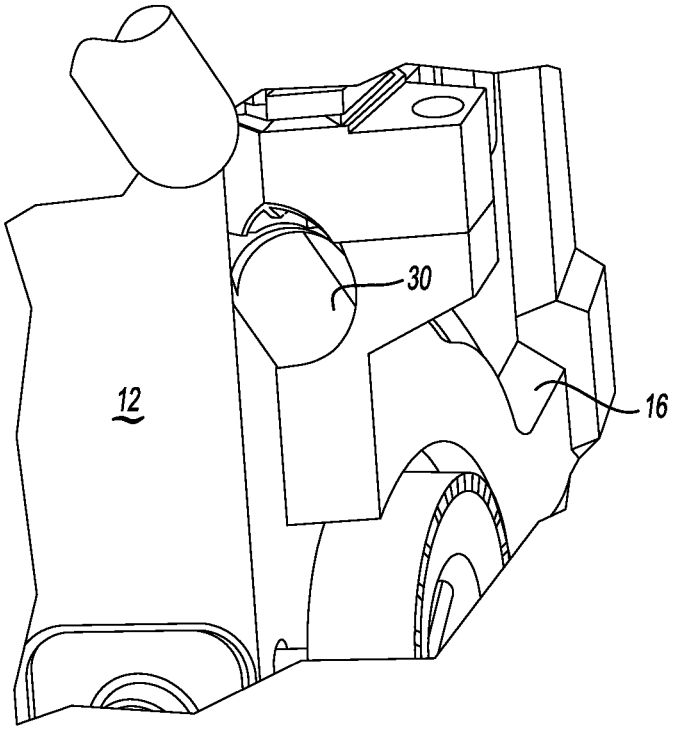
FIG. 3 is a partial perspective view illustrating the pocket shown in FIG. 1.
Figure 4:
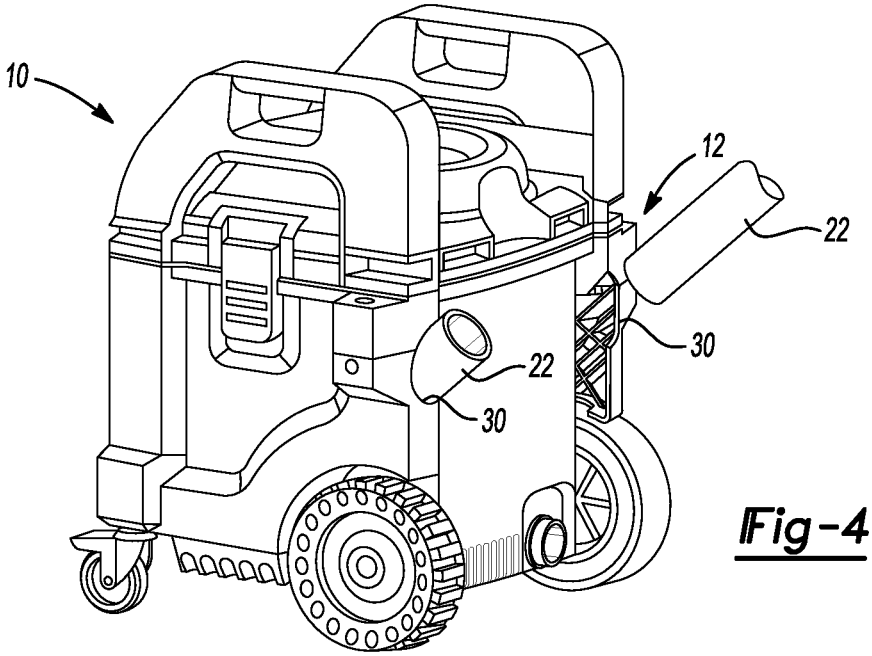
FIG. 4 is a partially exploded perspective view of the vacuum according to the principles of the present disclosure.

In an exemplary embodiment, vacuum 10 can include a plurality of bumpers 16 fixedly mounted to housing 12 or integrally formed with housing 12. As best shown in FIG. 3, bumper 16 may be configured to provide a pocket 30. Pocket 30 is adapted to slidably receive and retain extension wand 22, as shown in FIG. 4. In this manner, a substantial portion of extension wand 22 may be stored within the profile of bumper 16, minimizing the overall footprint of vacuum 10.

Figure 5:
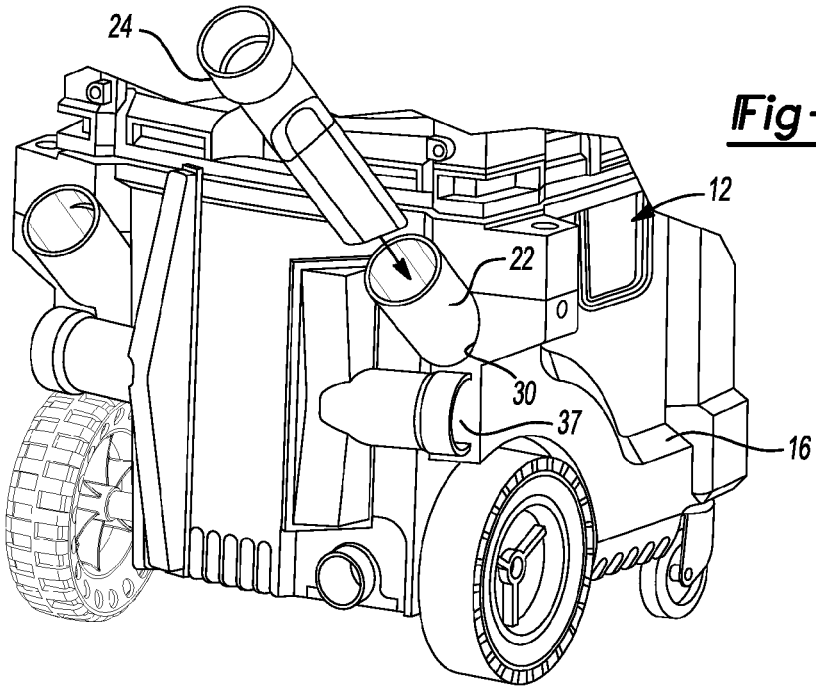
FIG. 5 is a partially exploded perspective view illustrating the crevasse tool shown in FIG. 1.

Crevasse tool 24 may be slidably received within extension wand 22, as shown in FIG. 5. Alternatively, crevasse tool 24 may be slidably engaged directly with pocket 30, and may be stored therein when not in use. In an alternative embodiment, bumper 16 may be adapted to slidably receive floor nozzles 26, 28 within pocket 30.

Figure 6:
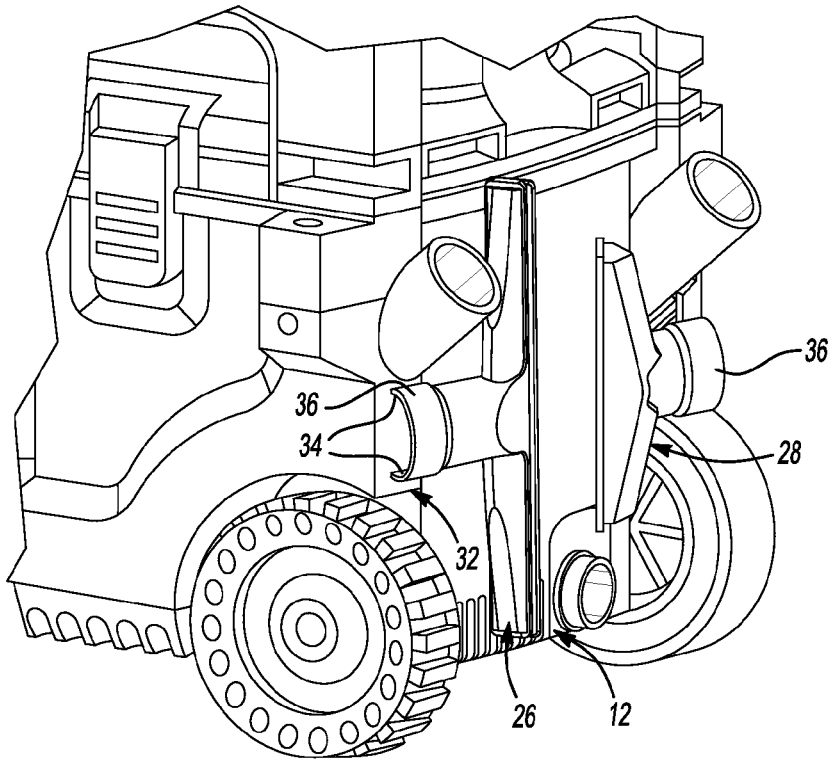
FIG. 6 is a partial perspective view of the vacuum according to the principles of the present disclosure.

As shown in FIG. 6, bumper 16 may also include retention feature 32 adapted to retain floor nozzle 26 or 28. Retention feature 32 may include one or more slots 34. A stem 36 of floor nozzle 26, 28 may be slidably received within slots 34, and the friction therebetween may retain the floor nozzle 26, 28 therein. In this manner floor nozzles 26, 28 may be stored substantially flush to housing 12 to minimize the overall footprint of vacuum 10.

Alternatively, retention feature 32 may include a protrusion 37, as shown in FIG. 5, whose width is substantially equal to the inner diameter of stem 36. Stem 36 may be slidably engaged with the protrusion 37. The friction between stem 36 and the protrusion 37 may retain the floor nozzle 26, 28 to the protrusion 37.

Accessories including, for example, extension wands 22, crevasse tool 24, and floor nozzles 26, 28 may be stored substantially as shown in FIG. 1 while vacuum 10 is in operation. In this manner, a plurality of accessories are conveniently accessible, yet space-consciously and securely retained.

Figure 7:
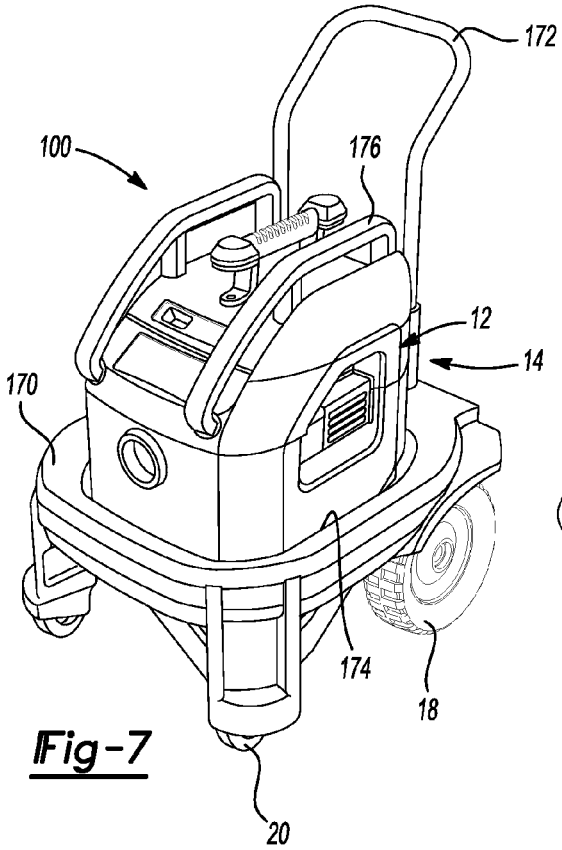
FIG. 7 is a perspective view of a vacuum according to an alternative embodiment of the present disclosure.
Figure 8:
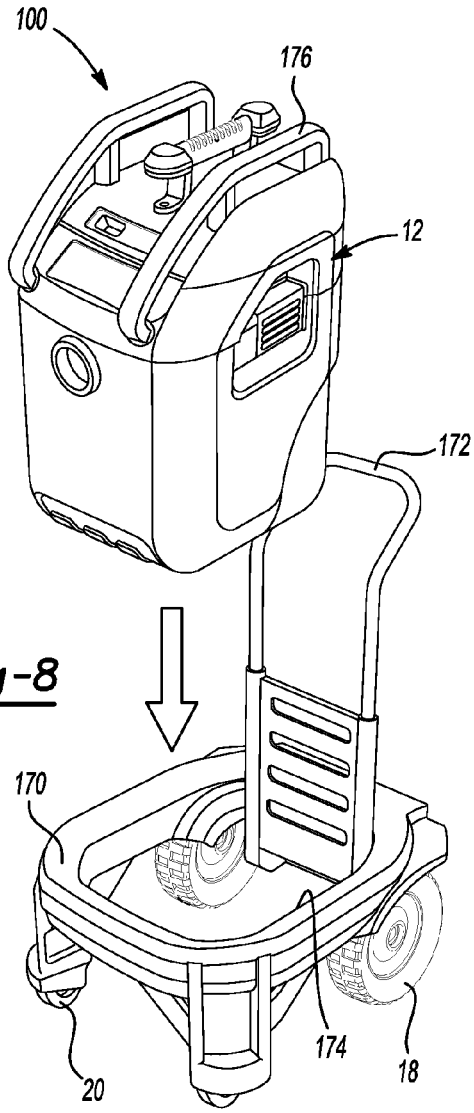
FIG. 8 is a partially exploded perspective view of a vacuum according to an alternative embodiment of the present disclosure.
Figure 9:
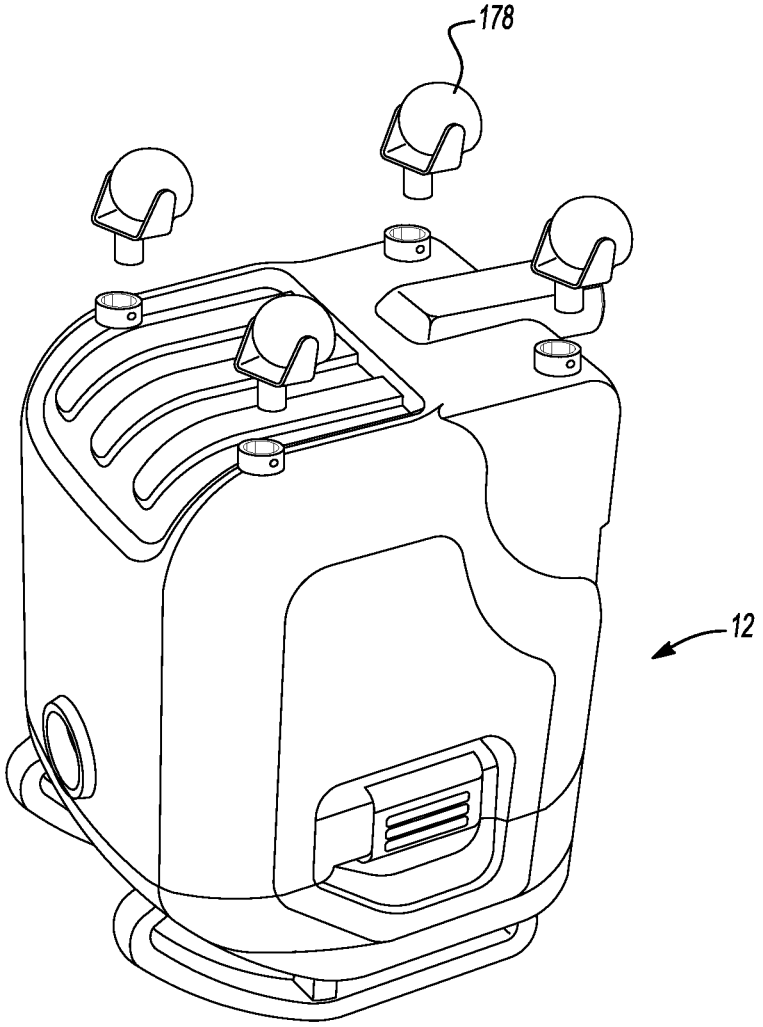
FIG. 9 is a partially exploded bottom perspective view of the housing according to an alternative embodiment of the present disclosure.

With reference to FIGS. 7-9, wherein common reference numerals are used to represent common elements as disclosed in FIGS. 1-6, an alternative embodiment is shown. Vacuum 100 includes a housing 12, an internal suction device 14, and a frame 170. Frame 170 may include a handle 172 and a plurality of wheels 18 and/or caster wheels 20. Frame 170 may also include accessory storage features (not shown) such as those provided in bumpers 16, as described above.

In an exemplary embodiment, frame 170 may include a plurality of relatively larger wheels 18 and relatively smaller caster wheels 20. The caster wheels 20 are pivotable to facilitate steering and maneuverability of vacuum 100. It should be appreciated that the number and arrangement of wheels 18 and/or caster wheels 20 may be varied to facilitate stability and maneuverability.

Handle 172 may be utilized to apply pushing and pulling forces to cause movement of vacuum 100. An operator may apply a downward force to handle 172 to cause caster wheels 20 to be lifted off of the ground or floor. Thus causing vacuum 100 to be in direct contact with the ground or floor surface only through wheels 18. In this manner, vacuum 100 may be pushed or pulled to freely travel over job site impediments.

Housing 12 is disposed within an aperture 174 of frame 170. Aperture 174 and a bottom portion of housing 12 may be tapered downward to limit the distance through which housing 12 may be inserted. Alternatively, housing 12 may be disposed within aperture 174 and may be supported therein by a cross-member (not shown). In still other embodiments, housing 12 may be mounted to frame 170 via conventional fastening methods such as latches, clips, bolts, pins, or straps.

As shown in FIG. 8, housing 12 may be lifted and removed from frame 170. Housing 12 may include one or more handles 176 to facilitate lifting and removal of housing 12. Housing 12 may be repeatedly engaged and disengaged with frame 170 as desired. Vacuum 100 may be operated while housing 12 is disposed within frame 170. Alternatively, vacuum 100 may be operated independently from frame 170. Housing 12 may be disengaged from frame 170 to empty waste matter collected during operation. Housing 12 may also be disengaged from frame 170 to reduce the space occupied by vacuum 100 to promote ease of use and/or maneuverability in a space-limited environment.

As shown in FIG. 9, vacuum 100 may include a plurality of auxiliary wheels 178. Auxiliary wheels 178 may be pivotably engaged within housing 12. Auxiliary wheels 178 facilitate mobility and maneuverability while housing 12 is disengaged from frame 170. When engaged with frame 170, housing 12 may be sufficiently spaced from the ground or floor so that auxiliary wheels 178 do not contact the ground or floor. It should be appreciate that the number and configuration of auxiliary wheels 178 may be varied to facilitate stability and maneuverability.

The description of the present disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. A vacuum comprising:

an enclosed housing;

a suction device disposed within said enclosed housing; and a frame having a plurality of wheels mounted thereto and including an aperture adapted to removably receive said enclosed housing therein, said frame having a handle fixedly attached directly thereto.

2. The vacuum of claim 1, wherein said housing has a first end opposite a second end, and said second end is removably received within said aperture of said frame.

3. A vacuum comprising:

a housing;

a suction device disposed within said housing; and a frame having a plurality of wheels mounted thereto and including an aperture adapted to removably receive said housing therein, said frame having a handle fixedly attached thereto, wherein said housing has a first end opposite a second end, and said second end is removably received within said aperture of said frame, said second end of said housing includes a first taper that cooperates with a second taper formed on said aperture to limit a distance said housing is received through said aperture of said frame.

4. A vacuum comprising:

a housing;

a suction device disposed within said housing; and a frame having a plurality of wheels mounted thereto and including an aperture adapted to removably receive said housing therein, said frame having a handle fixedly attached thereto, wherein said housing has a first end opposite a second end, and said second end is removably received within said aperture of said frame, said second end of said housing includes a first taper that cooperates with a second taper formed on said aperture to limit a distance said housing is received through said aperture of said frame;

wherein said second end of said housing further comprises a plurality of auxiliary wheels that are attached to said housing independently of said frame.

5. The vacuum of claim 4, wherein said distance that said housing is received within said frame is selected such that said plurality of auxiliary wheels are positioned above a work surface when said housing is coupled to said frame.

6. A vacuum comprising:

a housing;

a suction device disposed within said housing; and a frame having a plurality of wheels mounted thereto and including an aperture adapted to removably receive said housing therein, said frame having a handle fixedly attached thereto, wherein said housing has a first end opposite a second end, and said second end is removably received within said aperture of said frame, said first end of said housing includes at least one handle.

7. A vacuum comprising:

a housing having a first end opposite a second end;

at least one housing handle coupled to said first end of said housing;

a plurality of auxiliary wheels directly coupled to said second end of said housing, said plurality of auxiliary wheels operable to enable said housing to be wheeled when said housing is in a first state;

a suction device disposed within said housing;

a frame defining an aperture adapted to removably receive said housing therein, said frame including a handle;

a plurality of wheels directly coupled to said frame about said aperture, said plurality of wheels operable to enable said housing to be wheeled when said housing is in a second state; and wherein in said second state said housing is received within said aperture of said frame.

8. The vacuum of claim 7, wherein said plurality of auxiliary wheels are removable.

9. The vacuum of claim 7, wherein said housing is removed from said frame in said first state.

10. A vacuum comprising:

an enclosed housing having a first end opposite a second end, said second end having a first taper;

at least one first handle coupled to said first end of said enclosed housing;

a suction device disposed within said enclosed housing;

a frame defining an aperture having a second taper;

a plurality of wheels coupled to said frame;

wherein said first taper of said enclosed housing cooperates with said second taper of said frame to removably receive said enclosed housing within said aperture; and a second handle fixedly attached directly to said frame.

11. A vacuum comprising:

a housing having a first end opposite a second end;

at least one housing handle coupled to said first end of said housing;

a plurality of auxiliary wheels directly coupled to said second end of said housing, said plurality of auxiliary wheels operable to enable said housing to be wheeled when said housing is in a first state;

a suction device disposed within said housing;

a frame defining an aperture adapted to removably receive said housing therein;

a plurality of wheels directly coupled to said frame about said aperture, said plurality of wheels operable to enable said housing to be wheeled when said housing is in a second state; and wherein in said second state said housing is received within said aperture of said frame.

* * * * *